US006551088B2

(12) United States Patent
Nguyen et al.

(10) Patent No.: US 6,551,088 B2
(45) Date of Patent: Apr. 22, 2003

(54) APPARATUS FOR SPINNING HOLLOW BICOMPONENT FILAMENTS

(75) Inventors: Hung Manh Nguyen, Charlotte, NC (US); James Richard Goodall, Charlotte, NC (US)

(73) Assignee: Arteva North America S.A.R.L., Zurich (CH)

( * ) Notice: Subject to any disclaimer, the term of this patent is extended or adjusted under 35 U.S.C. 154(b) by 50 days.

(21) Appl. No.: 09/888,961

(22) Filed: Jun. 25, 2001

(65) Prior Publication Data

US 2002/0195737 A1 Dec. 26, 2002

(51) Int. Cl.[7] ..... B29C 47/00; D01D 5/34

(52) U.S. Cl. ..... 425/131.5; 425/382.2; 425/464; 425/DIG. 217

(58) Field of Search ..... 425/131.5, 133.1, 425/464, 463, 467, 72.2, DIG. 217, 382.2; 264/DIG. 26, 171.1, 172.11, 172.14, 172.15

(56) References Cited

U.S. PATENT DOCUMENTS 3,176,346 A * 4/1965 Brazelton ..... 425/131.5
4,307,054 A * 12/1981 Chion et al. ..... 264/172.11
4,743,189 A * 5/1988 Samuelson et al. ..... 425/131.5
5,344,297 A * 9/1994 Hills ..... 425/131.5

* cited by examiner

*Primary Examiner*—Robert Davis
*Assistant Examiner*—Joseph S Del Sole
(74) *Attorney, Agent, or Firm*—Gregory N. Clements

(57) ABSTRACT

An apparatus for spinning hollow bicomponent filaments. The apparatus includes a distributor, a spinneret having holes and a shim having openings fixed between the distributor plate and the spinneret. The distributor supplies a first polymer having an MV to a first part of the spinneret holes and a second polymer having a lower MV to a recessed section of the spinneret. The shim openings are positioned above the spinneret holes and extend away from the first part of the holes to allow the second polymer to flow from the recessed section, through the shim openings, to a second part of the spinneret holes. The two polymers travel along the opposed first and second parts of the holes until exiting the spinneret through respective asymmetric C-shaped apertures. The apertures are sized so that hydraulic split does not occur between the polymers and consequently potential filament kneeing is obviated. Upon exiting the apertures, the polymers self-join to form hollow filaments and are quenched. Since the polymers have different MV properties, the filaments self-crimp into a spiral configuration.

14 Claims, 5 Drawing Sheets

Fig.5
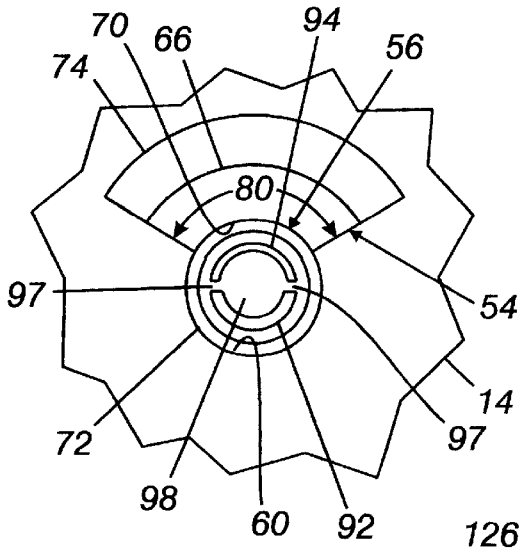
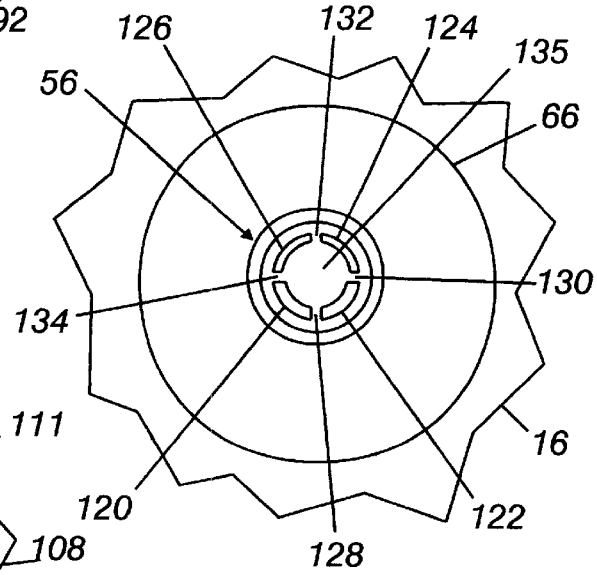
Fig.7
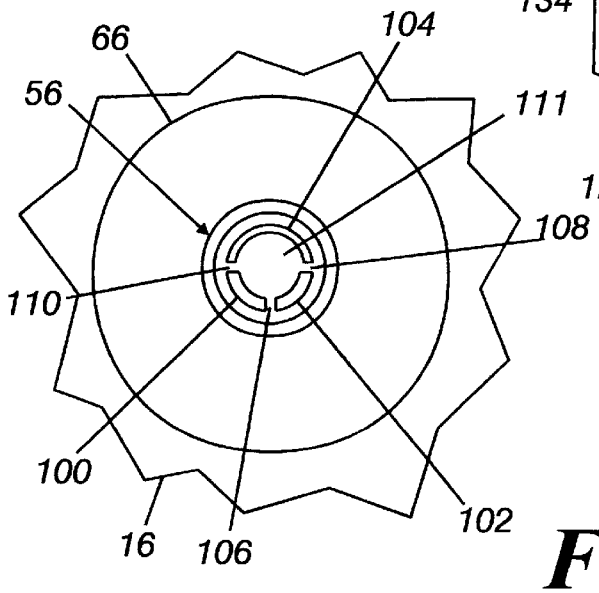
Fig.6

APPARATUS FOR SPINNING HOLLOW BICOMPONENT FILAMENTS

BACKGROUND OF THE INVENTION

1) Field of the Invention

The present invention relates to a method and apparatus for spinning hollow bicomponent filaments. More particularly, the invention relates to using a spinneret and a shim for hollow bicomponent filament spinning. More particularly still, the spinneret has a plurality of capillaries having asymmetric apertures, and the shim has a plurality of fan shaped openings.

2) Prior Art

Mono-component filaments are well-known and a variety of spinning packs and spinnerets have been employed in the production of hollow filaments. A conventional monofilament spinning assembly involves feeding polymer through spinneret holes then forcing the polymer through apertures at the bottom of the hole to form a hollow filament. Subsequently, the filament can be mechanically crimped to provide additional bulk.

Spinning packs are also well-known for the production of bicomponent filaments having side/side and sheath/core configurations. A conventional bicomponent spin pack assembly involves feeding molten sheath forming material to spinneret holes, in a direction perpendicular to the holes, and injecting molten core forming material into the sheath forming material as it flows into the spinneret holes.

Traditionally, use of bicomponent polymers to produce hollow filaments has been impeded by kneeing of the filament. For bicomponent hollow filament production, the polymers must first be fed to opposed parts of the spinneret hole and through opposed apertures in a bottom of the spinneret hole. Since the polymers have different melt viscosities (hereinafter MV) there is more resistance to the higher MV in going through its designated aperture than for the lower MV in going through its designated aperture. The difference in MV causes a hydraulic split where the higher MV polymer partially splits to egress the aperture designated for the lower MV polymer. The lower MV polymer, forced to egress a reduced aperture area, exits at a higher velocity causing the filament to "knee", that is veer substantially from a linear direction. Kneeing causes operational problems with the spin pack such as difficulty in extruding the filaments and increased filament breakage.

Accordingly, there is a need for an improved spin pack assembly wherein a hollow bicomponent filament can be produced without excessive kneeing. Additionally, there is a need for an improved shim for directing one polymer to a designated part of the spinneret hole. Further there is a need for improved spinneret openings each having apertures configured in the capillary to eliminate hydraulic split of the polymers. Lastly, there is a need for a self-crimping hollow bicomponent filament.

SUMMARY OF THE INVENTION

The present invention is directed towards a spin pack assembly and method for spinning hollow bicomponent filaments which do not knee and are self-crimping. Since each polymer has different properties, and in particular substantially different shrinkage rates, the bicomponent filaments will self-crimp in spiral after being drawn and heated. The spiral crimp bicomponent filaments have substantial bulk suitable for use in fiberfill for sleeping bags, winter quilted clothing and other similar applications requiring a high thermal insulation "R" value.

The spin pack assembly forms hollow self-crimping filaments by utilizing a unique shim and a spinneret having openings with asymmetric apertures to separately handle at least two polymer streams. Upon exiting the apertures, the polymer streams join to form self-crimping hollow filaments. The shim is provided with a plurality of openings which direct a first polymer to a first part of the spinneret holes while restricting the first polymer from a remaining part of the holes. Distributor holes offset from the holes in the spinneret, deliver a second polymer to the opposed remaining part of the spinneret holes. The polymers are then forced through separate apertures provided in a lower section of the spinneret holes. The apertures are configured to avoid hydraulic split of the polymers and accordingly avoid kneeing of the resulting hollow bicomponent filament.

In the broadest sense, the present invention also is directed towards a spin pack assembly comprising a distributor having outer flow passages for the flow of a first polymer and an inner polymer flow passage for the flow of a second polymer, and a spinneret secured relative to the distributor and communicating with the distributor to receive the first and second polymers. The spinneret has a top face directed towards the distributor, an opposed bottom face and a plurality of holes extending from the top face to the bottom face. The holes have a lower section which is provided with a plurality of apertures. Each of the apertures communicate with substantially only the inner flow passage or at least one of the outer flow passages.

In the broadest sense, the present invention also is directed towards a spin pack assembly comprising a distributor having outer flow passages for the flow of a first polymer and an inner polymer flow passage for the flow of a second polymer, and a spinneret secured relative to the distributor and communicating with the distributor to receive the first and second polymers. The spinneret has a top face directed towards the distributor, an opposed bottom face and a plurality of holes extending from the top face to the bottom face. The holes have a lower section which is provided with a plurality of apertures in which substantially only one of the first or second polymers egresses any one of the apertures. The first and second polymers flowing through the apertures are capable of forming hollow filaments due to the configuration of the apertures.

An object of the present invention is to configure the spinneret apertures with different cross-sectional areas.

Another object of the present invention is to limit the apertures to two C-shaped apertures.

Still another object of the present invention is to provide a shim secured between the distributor and the spinneret. The shim is provided with a plurality of openings having a first portion and a second portion. The first portion is positioned between a bottom section of the distributor outer flow passages and the spinneret holes to form a continuous path therebetween. The second portion extends from the first portion in a direction away from a first part of the holes to form a continuous course for polymers to flow from the spinneret, through the second portion, to a remaining part of the holes which is opposed to the first part.

A further object of the invention is to configure the first portion in circular shape and the second portion in block-arc shape. Additionally, the first portion is coaxial with the holes, and the second portion spans an arc of about 120 degrees.

A still further object of the present invention is to provide the distributor outer flow passages with a bottom section which is offset from the spinneret holes such that if the bottom sections were extended, the bottom sections would be positioned within the first part of the respective spinneret hole.

In the broadest sense, the present invention is directed towards a method for producing hollow bicomponent filaments. The method includes providing a distributor having a plurality of outer polymer flow passages which have a bottom section, and an inner flow passage. A spinneret, secured relative to the distributor and having a top face directed towards the distributor and an opposed bottom face, is also provided. Holes are provided in the spinneret which extend from the top face to the bottom face. The holes have a first part, a remaining part, and a lower section having a plurality of apertures. The holes are axially offset from the bottom sections such that the bottom sections would be positioned within the first parts if extended. A source for a first polymer and a source for a second polymer are provided. The first polymer is forced through the outer flow passages, through the first part of the holes and through any of the apertures positioned on the first part of the spinneret holes. The second polymer is forced through the inner flow passages, through the remaining part of the holes and through any of the apertures positioned in the remaining part of the spinneret holes. Upon exiting the apertures, the polymers form into filaments which are quenched.

BRIEF DESCRIPTION OF THE DRAWINGS

These and further features of the present invention will be apparent with reference to the following description and drawings, wherein:

FIG. 5 is an enlarged fragmented plan view of a shim intermediate opening positioned over a spinneret hole having apertures, taken through detail 5—5 of FIG. 1;

FIG. 6 is another embodiment of the spinneret hole shown in FIG. 5, having apertures of an alternative configuration, and with the shim removed; and FIG. 7 is a further embodiment of a spinneret hole shown in FIG. 5 having apertures of a further alternative configuration and with the shim removed.

DESCRIPTION OF THE PREFERRED EMBODIMENTS

Figure 1:
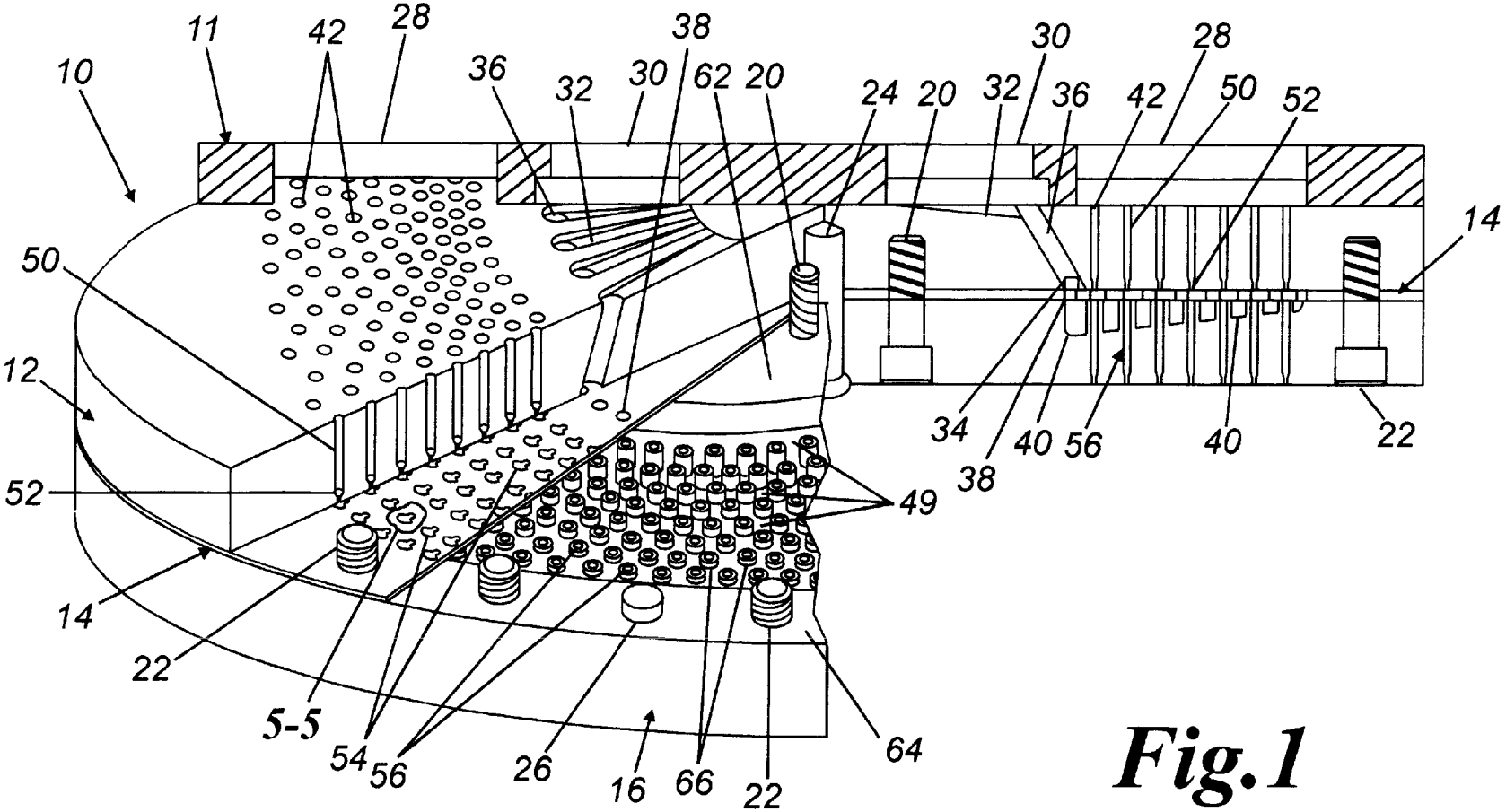
FIG. 1 is a fragmented perspective view of a spin pack assembly according to the preferred embodiment of the invention.
Figure 2:
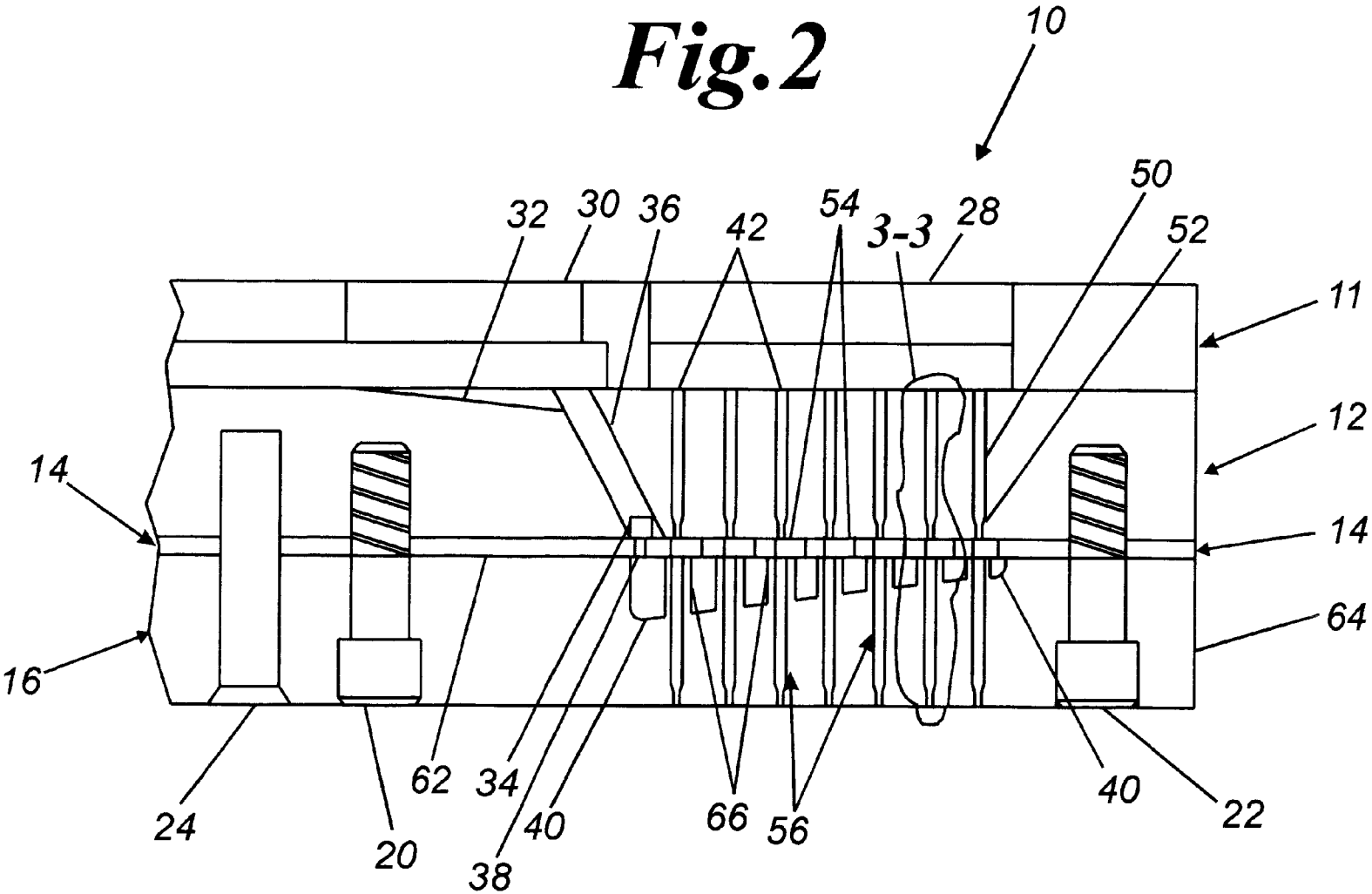
FIG. 2 is a fragmented elevational view, in cross section, of the spin pack assembly of FIG. 1.

FIGS. 1 and 2 illustrate a spin pack assembly 10 according to the present invention. The spin pack assembly 10 is configured in a stack and includes from top to bottom: a supply manifold 11, a distributor 12 fixed beneath the manifold 11, a shim 14 fixed beneath the distributor 12, and a spinneret 16 fixed beneath the shim 14. The distributor 12, shim 14 and spinneret 16 are provided with co-axial openings or threaded openings for receiving inner and outer rings of threaded bolts 20, 22. The rings of bolts 20, 22 secure the distributor 12, shim 14 and spinneret 16 together to overcome bowing and separation of the components. Additionally, the distributor 12, shim 14 and spinneret 16 are relatively positioned by a central dowel 24 in the center of the spin pack assembly and by outer dowel 26 interposed along the outer ring of bolts 22. The spin pack assembly 10 components are manufactured from a high strength material such as, for example, stainless steel.

First and second polymers are forced through the spin pack assembly 10 generally in the top to bottom fashion that the components are arranged. The polymers can be any spinnable polymer such as, for example, polyolefin, polyester or nylon.

The manifold 11 forces a first molten polymer and a second molten polymer via conventional pump and filter means (not herein illustrated) through respective outer and inner feed conduits 28, 30 to the distributor 12. The distributor 12 is provided with radial outward directed feed channels 32 in the top surface of the distributor 12, an annular channel 34 formed in the bottom surface of the distributor 12, and inner passages 36 which connect the feed channels 32 to the annular channel 34. The annular channel 34 disburses the second polymer to the shim 14 in a circular ring pattern. The shim 14 is provided with inner openings 38, arranged in a circular ring pattern which coincides with the annular channel 34, to allow passage of the second polymer from the annular channel 34 to a recessed section 40 of the spinneret 16.

Figure 3:
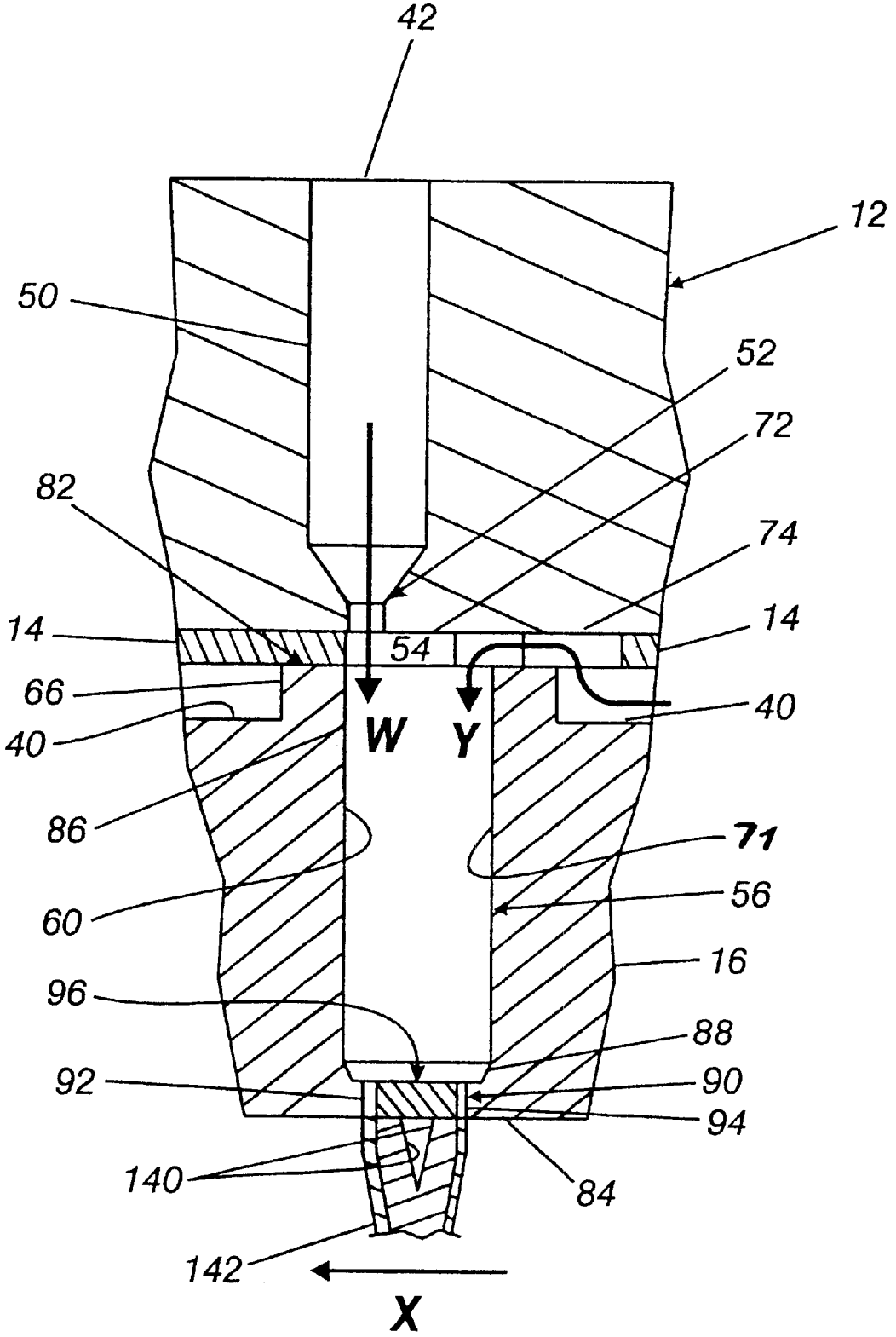
FIG. 3 is an enlarged fragmented elevational view, in cross section, of an outer distributor passage and a spinneret hole taken through section 3—3 of FIG. 2, and having an enlarged hollow filament, shown in cross section, extending from the spinneret hole.

As shown in FIGS. 2 and 3, the distributor 12 also includes outer passages 42 which provide passage for the first polymer from the manifold 11, through the distributor 12, to the shim 14 and the spinneret 16 positioned therebeneath. The outer passages 42 have an upper counterbore 50 and a lower tapered bottom 52. The tapered bottoms 52 are positioned immediately above intermediate openings 54 provided in the shim 14.

Particularly illustrated in FIG. 3, the tapered bottoms 52 are also spaced above, and axially offset from, corresponding spinneret holes 56. The tapered bottoms 52, intermediate openings 54, and spinneret holes 56 are related such that that if the tapered bottoms 52 were extended they would pass through the intermediate openings 54 and into a first part 60 of the spinneret holes 56. That is, a passage (indicated by arrow W) guides the first polymer from the tapered bottoms 52 to the first part 60 of the spinneret holes 56. Accordingly, the first polymer does not flow co-axial with a longitudinal center-line of the holes 56. Preferably, the first part 60 is the part of the holes 56 radially closest to the center of the spinneret 16 (arrow X points towards the center of the spinneret) to maximize the property difference in the first and second polymers during quenching, as discussed below.

As illustrated in FIGS. 1 and 2, the spinneret 16 includes a central hub 62, an outer rim 64 and the interposed recessed section 40. Cylindrical bosses 66, each provided with the co-axial spinneret hole 56, vertically extend from the recessed section 40 and terminate in a plane common with a top surface of the outer rim 64 and the central hub 62. The recessed section 40 defines a volume between the central hub 62 and the rim 64 for conveyance of the second polymer which is received by the spinneret 16 from the inner passages 36. The recessed section 40 is preferably deeper nearer the central hub 62 and shallower near the outer rim 64 to maintain the second polymer under constant pressure. The second polymer flows within the recessed section 40 between the bosses 66 and is confined between the central hub 62 and outer rim 64.

The shim 14 is unitary, has a uniform thickness, and slightly separates the distributor 12 from the spinneret 16.

Figure 4:
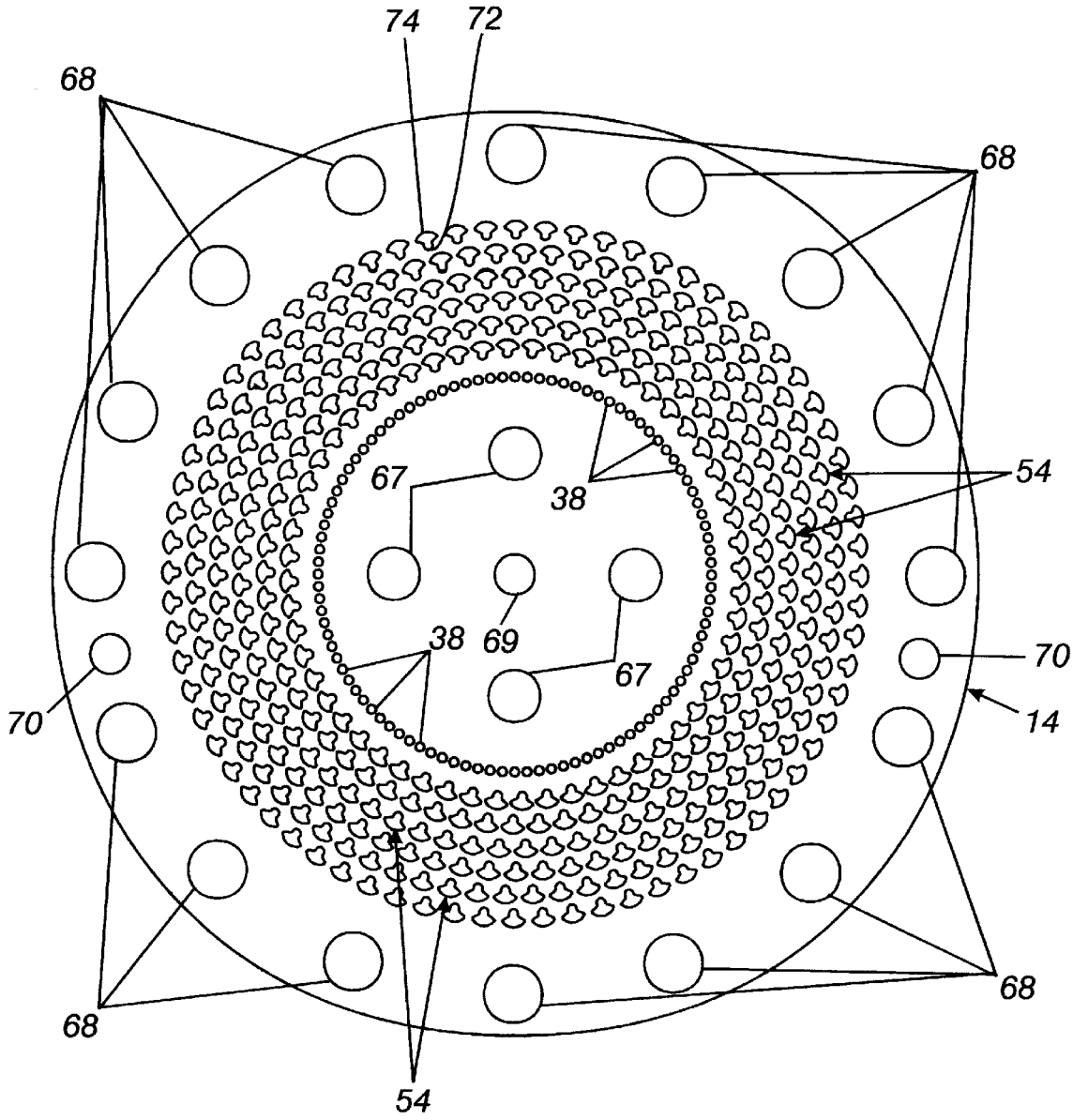
FIG. 4 is a plan view of a shim having openings.

Various openings in the shim 14 are shown in FIG. 4 and include respective openings 67, 68, 69, 70, for receiving the inner and outer ring of bolts 20, 22 and the central and outer dowels 24, 26. The shim 14 is also provided with the inner openings 38 and the intermediate openings 54 to direct passage of polymers. The shim 14 sets in the plane common with the terminal ends of the bosses 66 and is flush against the bosses 66 to restrict polymer from entering the spinneret holes 56 except via the intermediate openings 54, as shown in FIGS. 2, 3 and 5.

As illustrated in FIG. 3, the intermediate openings 54 are configured to allow unrestricted passage (arrow W) of the first polymer directly from the distributor 12 to the first part 60 of the spinneret holes 56. Additionally, the intermediate openings 54 allow passage of the second polymer along a continuous course (indicated by arrow Y) to a remaining part 71 of the spinneret holes 56 opposed to the first part 60.

Although different intermediate opening 54 configurations can be used, the preferred formation, shown in FIGS. 4 and 5, consist of a circular section 72 contiguous with a block-arc section 74. FIG. 5 illustrates that the circular sections 72 are co-axial with, and substantially the same size as, the spinneret holes 56. The block-arc sections 74 extend from the circular section 72 in a direction away from the first part 60 of the spinneret holes 56 and terminate beyond the corresponding boss 66. As shown in FIG. 3, the continuous course (arrow Y) for the second polymer is provided from the recessed section 40, through the block-arc section 74, over the boss 66, and thereafter past circular section 72 to the remaining part 71 of the hole 56. To obviate the second polymer from being trapped in dead-space near the rim 64 of the spinneret 16, the block-arc section 74, and consequently the continuous course (Y), is preferably oriented at a part of the hole 56 radially furthest from the center of the spinneret 16.

Per FIG. 5, the block-arc section 74 spans in an arc 80 in the range of about 90 degrees to about 180 degrees, and preferably approximately 120 degrees. As a further alternative, the block-arc section 74 can be partitioned, such as for example, by having a first block-arc section and a second block-arc section each spanning about 60 degrees with a land therebetween (not shown).

As shown in FIG. 3, the spinneret holes 56 are co-axial with the bosses 66 and extend from a top face 82 to a bottom face 84 through the spinneret 16. The holes 56 have a counterbore top section 86, a tapered transition section 88 and a lower section 90. The lower section 90 includes opposed first and second apertures 92, 94 (more clearly shown in FIG. 5) extending from an intermediate surface 96 of the hole 56 to the bottom face 84 of the spinneret 16.

In an embodiment, FIG. 5 shows the first aperture 92 positioned in the first part 60 of the hole 56 and the second aperture 94 positioned in the opposed remaining part 71 of the hole 56. The apertures 92, 94 are shaped as ½ of a circular annulus. That is, each aperture 92, 94 extends 180 degrees in an elongate arc. A pair of opposed lands 97 space the apertures 92, 94 apart and integrally join a center core 98 with the spinneret 16. The apertures 92, 94, taken with the lands 97, form a slightly elongated circular annulus. Stated another way, if the apertures 92, 94 were positioned end-to-end, they would form a circular annulus. The lands 97 are as narrow as possible so that the first and second polymers will join together after exiting the respective apertures 92, 94 while balancing the need to maintain the integrity of the center core 98.

Although configuring each aperture as ½ of a circular annulus is preferred, other configurations are also acceptable such as accurate, semi-circular, oval and even linear. Apertures which are generally semi-circular are defined as being C-shaped.

The apertures 92, 94 are further characterized as being asymmetric, that is, each having a different cross-sectional area. The first aperture 92 has a greater cross-sectional area than the second aperture 94, and in particular, the first aperture 92 is wider than the second aperture 94. The cross-sectional areas are derived according to the MV ratio of the polymers so that hydraulic split is avoided. Accordingly, substantially only one polymer egresses from any one aperture. That is, each aperture communicates with substantially only the inner passages 36 or one of the outer passages 42 so that any hydraulic split is sufficiently de minimis and virtually no kneeing of the resulting filament occurs. For example when using PET, the asymmetric apertures 92, 94 can be configured to enable spinning of polymer at intrinsic viscosity (hereinafter "IV") combinations such as 0.5/0.67 IV, 0.63/0.8 IV and 0.55/0.8 IV without hydraulic split. Each aperture configuration is prefixed on providing a larger aggregate cross-sectional area for the higher IV polymer than the lower IV polymer, based upon the IV ratio of the polymers, to avoid hydraulic split.

Alternative aperture configurations are illustrated by FIGS. 6 and 7. The alternative embodiments have the same spinneret 16, boss 66 and hole 56 arrangement as discussed above, but with a different aperture configuration. Also, by increasing the number of lands, the center core is further maintained against failure of lands due to stress from hydraulic pressures of the polymers.

In particular, FIG. 6 shows an alternative aperture configuration including first and second apertures 100, 102 which have a larger cross-sectional area in aggregate than a third aperture 104. The apertures 100, 102, 104 are separated by respective lands 106, 108, 110 and define a center core 111 therebetween. The first polymer is directed through the first and second apertures 100, 102 and the second polymer through the third aperture 104.

Similarly, FIG. 7 shows four apertures 120, 122, 124, 126, separated by lands 128, 130, 132, 134, and defining a center core 135. The first and second apertures 120, 122, in aggregate, have a larger cross-sectional area than the combined third and fourth apertures 124, 126. The higher MV first polymer is directed through the first and second apertures 120, 122, while the lower MV second polymer is directed through the third and fourth apertures 124, 126.

As a further alternative, the apertures could be configured as three or more semicircular apertures equally spaced in a circular pattern. Additionally, each aperture could be of equal cross-section or have different cross-sectional areas. Likewise, linear apertures could be positioned in the shape of a triangle with the apertures having equal or different cross-sectional areas. In each case, the total cross-sectional area through which each polymer flows is based on the MV ratio of the polymers to avoid hydraulic split. Accordingly, where the apertures have the same cross-section, a greater number of apertures will be designated for handling the higher MV polymer than for the lower MV polymer. The myriad of possible aperture configurations is not limited by the embodiments illustrated or described herein.

In operation, the distributor 12 receives the first and second polymers from the manifold 11 through the respective outer and inner feed conduits 28, 30 and directs the polymers through the shim 14 to the spinneret 16, as shown in FIGS. 1 and 2. The first polymer is pumped through the outer passages 42, through the intermediate shim openings 54, and thereafter is received by the first part of the spinneret holes 56, as indicated by arrow (W) of FIG. 3. Per FIGS. 1 and 2, the second polymer is pumped to the feed channels 32, outwardly within the feed channels 32 to the inner passages 36, and thereafter through the inner shim openings 38 to the recessed section 40 of the spinneret 16. The pressure drop between the top surface of the bosses 66 and the bottom surface of the distributor 12, and the pressure drop between the sloping recessed section 40 and the bottom surface of the shim 14 create an overall pressure drop forcing the second polymer through the recessed section 40, through the block-arc shim sections 74, and over the bosses 66 to the remaining part 71 of the holes 56, as illustrated by arrow (Y) of FIG. 3.

In regards to FIGS. 3 and 5, the first polymer flows through the first part 60 of the holes 56 and the second polymer flows through the remaining part 71 of the holes 56. The higher MV first polymer is fed through the larger first apertures 92 positioned on the first part 60 of the holes 56, while the lower MV second polymer is fed through the smaller second apertures 94 positioned on the remaining part 71 of the holes 56, to avoid hydraulic split. Since the lands 97 minimally space the apertures 92, 94 apart, the terminal sides 140 of the molten polymers join after exiting the apertures 92, 94 to form a hollow filament 142 (shown in cross-section in FIG. 3). Upon exiting the apertures 92, 94, the hollow filament 142 is quenched. The quenching can be by any suitable manner, with radial quenching emanating from the center of the spinneret 16 preferred. Preferably also, the larger first apertures 92 are positioned radially closer to the center of the spinneret 16 than the corresponding smaller second apertures 94. Consequently, with radial quenching, the polymer having a higher MV is quenched at a slightly greater rate than the lower MV polymer so that the property differences between the polymers are maximized.

Although a composition of 50% for each polymer is ideal, the lower MV polymer generally constitutes about 30% to 50% of the filament with a typical amount of about 40%.

Although particular embodiments of the invention have been described in detail, it will be understood that the invention is not limited correspondingly in scope, but include all changes and modifications coming within the spirit and terms of the claims appended hereto.

What is claimed is:

1. A spin pack assembly for the production of hollow bicomponent filaments comprising:

a distributor having a plurality of outer polymer flow passages for the flow of a first polymer and an inner polymer flow passage for the flow of a second polymer;

a spinneret secured relative to said distributor and communicating with said distributor to receive the first and second polymers, wherein said spinneret includes a top face directed towards said distributor, an opposed bottom face and a plurality of holes extending from said top face to said bottom face, wherein said holes have a lower section which includes a plurality of apertures and wherein each of said apertures communicate substantially only with either said inner flow passage or at least one of said outer flow passages; and a shim secured between said distributor and said spinneret, said shim having a plurality of openings, each of said openings having adjacent first and second portions, wherein said first portion forms a continuous path from said outer flow passage, through said openings to said holes, and said second portion forms a continuous path from said inner flow passage, through said openings to said holes.

2. A spin pack assembly for the production of hollow bicomponent filaments comprising:

a distributor having a plurality of outer polymer flow passages for the flow of a first polymer and an inner polymer flow passage for the flow of a second polymer;

a spinneret secured relative to said distributor and communicating with said distributor to receive the first and second polymers, wherein said spinneret includes a top face directed towards said distributor, an opposed bottom face, and a plurality of holes extending from said top face to said bottom face, wherein said holes have a lower section which includes a plurality of apertures whereby the first polymer and the second polymer flowing through said apertures form into hollow filaments; and a shim secured between said distributor and said spinneret, said shim having a plurality of openings, each of said openings having adjacent first and second portions, wherein said first portion forms a continuous path from said outer flow passage, through said openings to said holes, and said second portion forms a continuous path from said inner flow passage, through said openings to said holes.

3. The spin pack assembly of claim 2 wherein said apertures have different cross-sectional areas.

4. The spin pack assembly of claim 3 wherein said plurality of apertures consists of a first aperture and a second aperture.

5. The spin pack assembly of claim 4 wherein said first and second apertures are generally C-shaped.

6. The spin pack assembly of claim 2 wherein said outer flow passages have a bottom section that is axially offset from said holes such that if said bottom sections were extended said bottom sections would be positioned within a first part of said hole.

7. The spin pack assembly of claim 6 wherein said first part is a part of the hole closest to a center of said spinneret.

8. The spin pack assembly of claim 6 wherein said second portion extends from said first portion in a direction away from said first part of said hole to form a continuous course from said spinneret, through said second portion, to a remaining part of said hole opposed to said first part.

9. The spin pack assembly of claim 8 wherein said first portion is circular shaped and coaxial with said holes and said second portion is block-arc shaped.

10. The spin pack assembly of claim 9 wherein said second portion spans in an arc in a range from about 90 to about 120 degrees.

11. The spin pack assembly of claim 10 wherein said second portion spans in an arc approximately 120 degrees.

12. The spin pack assembly of claim 8 wherein said apertures have different cross-sectional areas.

13. The spin pack assembly of claim 12 wherein said plurality of apertures is a first aperture positioned in said first part and a second aperture positioned in said remaining part, said first aperture having a larger cross-sectional area than said second aperture and said first and second apertures are generally C-shaped, and said holes are axially offset from respective said bottom sections so that said bottom sections would be positioned within said first part if extended.

14. The spin pack assembly of claim 13 wherein said first part is closer to a center of said spinneret than said remaining part.

* * * * *